United States Patent [19]

Johnstone et al.

[11] Patent Number: 4,853,085

[45] **Date of Patent: * Aug. 1, 1989**

[54] NEUTRAL SIZED PAPER FOR USE IN THE PRODUCTION OF GYPSUM WALLBOARD

[75] Inventors: Norman E. Johnstone; John R. Kehoe, both of Schaumburg, Ill.

[73] Assignee: United States Gypsum Company, Chicago, Ill.

[ * ] Notice: The portion of the term of this patent subsequent to Feb. 8, 2000 has been disclaimed.

[21] Appl. No.: 441,711

[22] Filed: Nov. 15, 1982

Related U.S. Application Data

[63] Continuation-in-part of Ser. No. 263,371, May 13, 1981, Pat. No. 4,372,814.

[51] Int. Cl.[4] ..... D21H 1/02

[52] U.S. Cl. ..... 162/128; 162/135; 162/158; 162/168.1; 162/169; 162/181.1; 162/181.3; 428/703; 428/537.7

[58] Field of Search ..... 162/124, 128, 168.3, 162/169, 135, 158, 181.1, 181.2, 183, 184, 168.1, 168.2; 428/537, 703; 156/39, 41, 44

[56] References Cited

U.S. PATENT DOCUMENTS

| | | | |
|---|---|---|---|
| 3,102,064 | 8/1963 | Wurzburg et al. | 162/158 |
| 3,300,371 | 1/1967 | Hart | 162/128 |
| 4,064,317 | 12/1977 | Fukuba et al. | 428/537 |
| 4,204,030 | 5/1980 | Takamizawa et al. | 428/703 |
| 4,311,767 | 1/1982 | Kennedy | 428/537 |

OTHER PUBLICATIONS

Casey, *Pulp and Paper,* vol. II, (1960), p. 947.

Kirk-Othmer II, "Encyclopedia of Chemical Technology", Third Edition, vol. 16, pp. 777-779, (1981).

*Primary Examiner*—Peter Chin

*Attorney, Agent, or Firm*—Samuel Kurlandsky; Robert H. Robinson; John M. Lorenzen

[57] ABSTRACT

A paper particularly adapted for use as cover sheets in the production of gypsum wallboard, the paper having improved porosity and strength to permit better drainage and more rapid drying in the production of the paper to permit less fiber to be utilized, and to permit less heat to be utilized in drying the paper, providing for production of superior gypsum board. The paper comprises in weight percent:

(A) fibers having a fiber freeness of from about 350 to 550 ml. Canadian Standard Freeness, (B) a buffering agent in an amount from about 0.25 to about 10%, (C) a neutral sizing agent in an effective amount to prevent water penetration, and (D) a cationic starch.

In a preferred embodiment the paper is treated with a neutral internal sizing agent during its formation, and subsequently treated with a surface sizing agent after formation of the paper, in order to provide certain properties including better adhesion to the gypsum core.

28 Claims, No Drawings

NEUTRAL SIZED PAPER FOR USE IN THE PRODUCTION OF GYPSUM WALLBOARD

RELATED APPLICATIONS

This application is a continuation-in-part of copending application U.S. Ser. No. 263,371 filed May 13, 1981 now U.S. Pat. No. 4,372,814, by the present inventors.

BACKGROUND OF THE INVENTION

1. Field of the Invention

The present invention relates to paper-making, and more particularly refers to the production of a neutral sized paper particularly well adapted for use as cover sheets in the production of gypsum wallboard.

2. Description of the Prior Art

Paper for gypsum board is conventionally made by pulping up waste paper constituents of old corrugated paper, or kraft cuttings and waste news. In cleaning, screening and refining the suspended materials in water suspension, the process paper stock is diluted still further with water and then formed by draining the plies of paper on several continuously moving wire cylinders, where the separate plies are joined together by a carrying felt. The weak paper web is then dewatered in a press section where water is pressed out of the web. The pressed paper is dried in a multi-cylinder drying section with steam added to each cylinder. The dried paper is subjected to a squeezing or calendaring operation for uniformity in thickness and is then finally wound into rolls. The paper is subsequently utilized as paper cover sheets to form gypsum wallboard by depositing a calcined gypsum slurry between two sheets, and permitting the gypsum to set and dry.

Conventional paper used in gypsum wallboard has definite limitations with regard to the utilization of heat energy. First, it has definite drainage limitations in forming and pressing, and additional limitations in the drying rate. The drainage rate limitations impose a large paper drying energy load on the mill. It would be highly desirable to have a more porous paper for utilization as paper cover sheets in the formation of gypsum wallboard to permit the achievement of a substantial reduction in drying energy load, while still having a paper which has the requisite physical properties with regard to physical strength even though less pulp is utilized.

SUMMARY OF THE INVENTION

It is accordingly an object of the invention to provide paper for use as paper cover sheets in the production of gypsum wallboard.

It is another object of the invention to provide paper for use in making gypsum wallboard which is highly porous and requires less energy for drying than conventional paper previously utilized for this purpose.

It is still another object to provide a paper of the type described which has sufficiently high tensile strength for use in gypsum wallboard.

It is still a further object to provide a porous paper for making gypsum wallboard which is so treated that excellent adhesion is obtained between the paper cover sheet and the gypsum core even though the paper has a greater porosity than that found in conventional paper.

Other objects and advantages of the invention will become apparent upon reference to the description below.

According to the invention, a paper eminently suitable for use in fabricating gypsum wallboard is produced using substantially conventional paper processes, and having the following composition (dry weight basis):

(A) cellulose fibers,
(B) a neutral sizing agent in an effective amount to prevent water penetration,
(C) a cationic starch, and
(D) a buffering agent in an amount from about 0.25 to about 10%, capable of maintaining the pH of the paper stock at a value of at least 7.

In a preferred embodiment the paper is treated with a neutral internal sizing agent during its formation, and subsequently treated with a surface sizing agent after formation, in order to provide better adhesion to the gypsum core.

During the paper-making process, rapid drying is obtained with less than the normal amount of heat energy required. The finished paper has excellent porosity, tensile strength and fire resistant properties. Further, when the paper is utilized as paper cover sheets in the manufacture of gypsum wallboard, the porosity and lighter weight of the paper facilitate the drying and setting of the finished wallboard.

Many advantages are obtained from the practice of the present invention. The use of an internal neutral or slightly alkaline size results in a paper sheet which is stronger than that made with an acid size such as rosin and alum. Consequently, a sheet of comparable strength to that of the conventional rosin-alum sized sheet may be obtained while using less cellulose fibers. This results in a thinner sheet which drains more readily and more rapidly, and requires less heat for drying, resulting in substantial fuel savings. Alternatively, weaker and less expensive fiber may be utilized, since neutral size does not weaken the fibers. When an acid size such as rosin and alum is used the fibers are materially weakened. An alum and rosin sized sheet is acid by nature due to the addition of the alum. Being acid, the fibers which make up the sheet are stiff and generally tubular and non-conformable. As a result, the bonding provided by these fibers is poorer than that which may be obtained with a more conformable fiber. In contrast, paper which is made with neutral size consists of fibers which are conformable. They assume a flatter position more readily than fibers which are subjected to acid. As a result they provide better bonding and better strength. Consequently, as stated, the improved strength properties of the sheet imparted by the neutral sized fibers can be utilized to reduce the basis weight of the sheet, that is, the amount of materials utilized, and/or to reduce the amount of hard stock used to maintain the strength of the sheet. Other advantages obtained through the use of neutral size are reduced corrosion on the paper machine and a generally cleaner system than an alum and rosin system.

Additionally through the use of a surface size, improved uniformity of internal sizing is obtained. Because of this, the amount of the surface size application may be reduced, while still obtaining good results. Moreover, when manila paper is used, a significant increase in the soft stock content may be utilized. This is made possible by the improved strength of the sheet under like conditions when neutral size is used. The same advantages are obtained when using other papers.

A further advantage has been observed. When paper machines formed of non-corrosion-resistant metal parts are used, such as those made of steel and iron, corrosion is greatly reduced. This result is obtained because the system utilizing neutral size is maintained at a pH of about 7.0–7.8. Consequently the ferrous metal parts are not attacked. On the other hand, the pH conditions of 4.5–5.0, as experienced in the use of an alum and rosin size, cause corrosion of unprotected non-corrosion-resistant metals.

The large reduction or elimination of both alum and rosin size results in a stock system which is a lot cleaner ionically and chemically. This means that fewer problems are encountered with chemical buildup which causes variations in paper quality and excessive filling of the paper machine cylinder wires. Additionally fouling of carrying felts results in a high frequency of shutdowns for cleaning. The use of neutral size also greatly reduces the conditions of high chemical buildup in the system, which may contribute to the above difficulties.

The cationic starch of the invention has several functions. First, it acts as an emulsifying medium in which the size particles are dispersed. Second, it serves to coat the individual particles of size to protect them from hydrolysis. Third, the cationic starch imparts a positive charge to the individual size particles causing them to remain separated from each other. Fourth, the cationic starch serves to attach the size particles electrostatically to individual cellulose fibers. Fifth, the cationic starch acts as a retention aid or binder for the size particles and maintains them affixed to the cellulose fibers. Sixth, the cationic starch enhances the tensile strength of the final paper by improving the fiber-to-fiber bond. Finally, the cationic starch acts as a retention aid to retain the buffer particles, such as calcium carbonate, to the paper fibers.

The buffering agent is utilized to maintain the internal neutral size at a pH of at least 7 and preferrably 7 to 7.8. This prevents acid conditions from occurring which would be detrimental to fiber strength. If the acidity of the furnish in the system is not neutralized by the presence of the buffer, the system becomes acid from the acidity in the waste paper furnish and the benefits of the neutral size such as high sheet strength and reduced furnish cost can not be achieved.

The surface size utilized on the surface of the bond liner prevents migration of starch out of the gypsum core and contributes towards better bond between the paper and the core. Suitable surface size materials are silicone resins. Their efficiency may be enhanced by the addition of an acid material to the silicone resin prior to application which assists in the polymerization of the silicone resin. Suitable acidic materials are alum and boric acid.

The sizing agents of the present invention are substituted cyclic dicarboxylic acid anhydrides corresponding to the following structural formula:

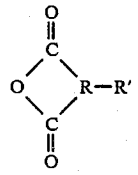

wherein R represents a dimethylene or trimethylene radical and wherein R' is a hydrophobic group containing more than 5 carbon atoms which may be selected from the group consisting of alkyl, alkenyl, aralkyl or aralkenyl groups. Substituted cyclic dicarboxylic acid anhydrides falling within the structural formula above are the substituted succinic and glutaric acid anhydrides.

Specific examples of the above described sizing agents include iso-octadecenyl succinic acid anhydride, n-hexadecenyl succinic acid anhydride, dodecenyl succinic acid anhydride, dodecyl succinic acid anhydride, decenyl succinic acid anhydride, octenyl succinic acid anhydride, nonenyl succinic acid anhydride, triisobutenyl succinic acid anhydride, capryloxy succinic acid anhydride, heptyl glutaric acid anhydride, and benzyloxy succinic acid anhydride. It has been found that optimum results are obtained with acid anhydrides in which R' contains more than twelve carbon atoms. In addition to the above individual compounds, mixtures of these compounds may also be employed.

Among the preferred neutral sizing compositions are Accosize 18 and Fibran 68. Accosize 18 is a trademarked product of American Cyanamid Company and is a substituted succinic acid anhydride having a total of from 15 to 20 carbon atoms, and contains about 1% of an anionic surfactant. Fibran 68 is a trademarked product of National Starch and Chemical Corporation and is a substituted succinic acid anhydride having a total of 15–20 carbon atoms. Fibran 68 normally does not contain any emulsifying agent. However, it is advantageous to add such an agent to promote the emulsification of the product. The amount of sizing agent employed may range from about 0.15% to about 0.35% of the dry weight of the finished paper. Larger amounts may be used without adverse effects, but the excess adds little to the sizing properties.

The cationic agent is useful in promoting or aiding the retention of the sizing agents and for bringing the agents into close proximity to the pulp fibers. Although any of a large number of cationic agents may be utilized in the invention, such as alum, aluminum chloride, long chain fatty amines, sodium aluminate, thermosetting resins and polyamide polymers, the preferred cationic agents are the various cationic starch derivatives including primary, secondary, tertiary or quarternary amine starch derivatives. Such derivatives are prepared from all types of starches including corn, tapioca, potato, waxy maize, wheat and rice. The cationic starch agent may be used in an amount by weight of from about 0.5% to about 0.7% based on the dry weight of the paper. A preferred cationic starch is Sta-Lok 500 manufactured by the A. E. Staley Manufacturing Company.

The buffer material may be any of a number of compounds which are salts of a cation of a strong base and an anion of a weak acid. Although a number of materials may be utilized such as sodium carbonate and sodium bicarbonate, the preferred buffering agent is calcium carbonate. This material is instrumental in maintaining the pH of the sizing agent and paper in a range of from about 7 to about 7.3. Additionally, the $CaCO_3$ buffer as filler improves sheet porosity and improves drainage rate, thereby facilitating the drying of the paper and reducing the amount of energy necessary to manufacture the paper and the resultant gypsum wallboard. An amount of at least 2% should be utilized. An amount greater than about 6% is no longer functional as a buffer, but larger amounts up to 10% and greater may be used where the calcium carbonate serves as both a buffer and a filler.

It has been found advantageous to provide a surface coating on the bond liner of the paper, that is, the surface of the paper which becomes affixed to the gypsum core of the wallboard. A preferred material is an epoxy resin such as a silicone emulsion RE-30 a trademarked material marketed by Union Carbide Corporation. Additionally, a silicone emulsion, Tego 5342A, a trademarked material manufactured and marketed by the Goldschmidt Chemical Corporation is suitable. Further, it has been found that even though the use of an acid material to facilitate setting or curing of a sizing agent is detrimental when used as an internal sizing agent, the use of an acid material such as alum or boric acid with the epoxy sizing agent as a surface size facilitates the cure of the epoxy resin, and, because it does not enter internally into the paper, does not adversely affect the strength of the paper fibers.

As stated, in order to achieve the required quality performance of neutral-size paper utilized to fabricate gypsum wallboard, the addition of a weak acid material such as alum to the dilute silicone emulsion in the concentration of 1% alum solids is critical for achieving optimum performance. In order to test the effectiveness of adding alum to the silicone utilized for surface sizing, a paper was utilized which has not been sized at all. A surface size was applied to this paper comprising 4 lb/ton of silicone solids. This provided only marginally acceptable levels of sizing, i.e. 1.0 grams plus Cobb test. To another paper sample a surface coating was applied utilizing the same amount of silicone solids with the addition of 1% alum solids. The sizing results of this surface application were greatly improved.

Prior to the use of the present novel application of alum to the external silicone size itself, it was found that neutral-sized paper which was contaminated at discreet points in the surface of the paper with dirt, shives and bark, and which was surface sized with untreated silicone emulsion had a tendency to form mini-cockles (dimples) in the gypsum wallboard. Subsequent field tests showed that the paper in the area of the dimpling was poorly sized internally and had substantial amounts of dirt in it.

When alum-treated silicone was applied to the surface of the paper in manufacture, the dimpling of the board was eliminated. It is believed that the alum-acidified silicone did not strike into the paper in the areas of poor internal sizing, whereas the untreated silicone did strike in. This strike-in defeated the purpose of the silicone which was to give uniform paper sizing to provide a cockle-free board. It is believed that where a surface size strikes into the sheet of paper it is unavailable at the paper surface to provide surface sizing.

Alum-treated silicone size is most effective when applied to the surface of a sheet having a filler of a material such as calcium carbonate which acts as a buffer. When the alum-treated silicone comes in contact with the calcium carbonate, the pH changes from 3.5–4.0 to neutrality. It is believed that this causes the silicone to cure out on the paper surface, thereby providing the desired sizing uniformity. The alum addition appears to have no appreciable adverse effect on the tensile strength of the resulting paper, nor any visible adverse effect on the stability of the silicone emulsion nor on its tendency to polymerize. Whatever curing effect takes place occurs as the silicone is applied to the surface of the unsized, neutral and 5% calcium carbonate filled paper.

In carrying out the experiments described below, full scale plant equipment and material amounts were utilized. In producing the neutral sized paper according to the invention, the general procedure described below as Procedure A was utilized. In producing paper according to conventional formulations utilizing acid size for use as a control or for comparison, the method described below as Procedure B was utilized. The methods are described as follows:

PROCEDURE A

A cationic starch-neutral size mixture was first prepared as follows. A pregelled, flaked cationic starch, either potato or corn starch was metered with a dry feeder into the mouth of a hopper-type eductor where the cationic starch was wetted out with cool fresh water and discharged into a 3,000 gallon tile-lined use tank.

The cationic starch solution at 3.5% solids was pumped from the use tank through a flow meter to a mixing tee where the neutral sizing agent, an oily liquid substituted succinic acid anhydride containing from 1–3% emulsifying agent, was mixed with the cationic starch solution. The mixture was passed through an emulsifier where the sizing agent was then emulsified in the cationic starch solution as the emulsifying medium. The emulsifier may be a turbine pump, a multi-vaned homogenizer, an eductor or any other device that will impact sufficient turbulence to the starch-sizing agent to reduce the sizing agent particle size to below about 5 microns in size. The preferred particle size is in the range of 1–2 microns.

In carrying out the process, sufficient volume and concentration of starch must be used to maintain a minimum ratio of starch solids to sizing agent of 2/1. The rate of dry starch solids used generally varies between 10 and 14 lb/ton of paper. The final sizing agent consistency in the starch-size emulsion is adjusted by dilution after emulsification with starch solution. The neutral size prepared as above was then added to the paper machine furnish.

A blend of varying ratios of hard and soft stocks, such as old corrugated stock and sections, respectively, on newslined paper, was pulped up, cleaned and refined, and then discharged into a 25,000 gallon tile-lined machine chest. Calcium carbonate was added to the paper stock in the machine chest at the rate of 2.5% of total dry stock including calcium carbonate. The resulting stock, termed "machine furnish" was then pumped at 3½% oven dry consistency to the mix boxes of the forming section of the paper machine.

The neutral size emulsion as formed above was uniformly added to the machine furnish in the mix boxes of the paper machine at rates varying between 3 and 7 lb/ton of paper, depending on sizing propensity of the furnish and sizing needs of the finished paper. The flow of furnish and size was directed to seven separate mix boxes and from there to seven separate fan pumps, where the sized furnish was diluted to approximately 0.5 to 1.5% consistency with recycled white water from the paper machine. The dilute, sized furnish or fiber suspension was pumped by means of the fan pumps to the continuously moving forming cylinders of the paper-making machine, where the furnish was formed into separate plies which were joined together on a continuously moving carrying felt. The water drained through the wire cover of the cylinders and flowed back to the separate fan pumps for dilution. A seven ply sheet was thus formed at 23–25% solids consistency and was carried on continuously moving felts through the press section of the paper machine, where the solids content of the sheet was increased to 40–45%. The sheet by itself was then passed into the drier section where it was dried to 1.5–2.5% moisture content on continuously turning drying cylinders loaded to a minimum steam pressure of 35 psig. A minimum sheet temperature of 270° F. was required for curing the size.

A silicone emulsion surface size was prepared in a 250 gallon stainless steel tank in the ratio with alum solution of 1%/2% on an as received basis. The actual content of silicone and alum are 0.4%/1% on a dry solids basis. This dilute sizing emulsion was pumped to a water box fixed to the King roll of the calender stack which directly follows the drier section. The dried sheet of paper as it passed out of the drier section was contacted with a film of dilute silicone emulsion carried up on the King roll on the side of the paper which subsequently constitutes the bond liner. The rate of silicone emulsion applied in this manner varied from 0.3 to 0.5 dry lb/ton of paper. The purpose of the silicone application was to impart sizing uniformity to the bond liner side of the paper. Alum was added to the silicone emulsion to promote the curing of the silicone polymer on the surface of the paper.

PROCEDURE B

PREPARATION OF CONVENTIONAL ROSIN AND ALUM (SIZED) PAPER FOR COMPARISON

Rosin size as received at 86% solids was further diluted and emulsified in an emulsifier and then stored as a dilute emulsion. The rosin size emulsion was then pumped to the mix boxes through a set of rotameters where the emulsion was metered to each mix box. Alum, at 50% solids, was further diluted to about 3 lbs. of solids per gallon of solution, and then pumped to the mix boxes via a set of rotameters wherein the alum was then distributed in the desired proportion to the mix boxes. The alum and rosin were then brought into contact with the machine furnish, the fiber stock going to the paper machine. Mixing was carried out in the mix boxes from which the furnish and the size and alum flowed through the fan pump, at which point the furnish was diluted with white water from the paper machine. This dilute stock was then caused to flow to forming cylinders on the paper machine where the furnish was made into individual plies. Seven plies were brought together to form a sheet and placed on a carrying felt. The sized sheet was then carried to the press section on carrying felts and from there transferred into the drier section. The sheet was then passed over turning drier cylinders loaded with steam internally for drying. The sheet was then passed into the wet stack where it was contacted with a dilute silicone emulsion. Sufficient alum was applied internally to the sheet to provide retention of rosin size and to facilitate the curing of the silicone emulsion which was subsequently transferred onto the paper to form the surface size. The paper was then passed through the dry stack and was made up into a reel for subsequent use in preparation of gypsum wallboard.

PREPARATION OF NEUTRAL SIZED PAPER

In the examples which follow, the preparation of various grades of paper to be utilized for the making of gypsum wallboard is described. The preparation of five basic grades are illustrated. These are 1. Manila, 2. Newslined, 3. Sheathing, 4. Paper for Plaster Application, and 5. Water Resistant Paper for High Humidity Applications. Examples of each were prepared using the neutral size and surface size of the present invention. Additionally, examples for each type of paper were prepared by conventional rosin and alum internal size for comparison.

EXAMPLE 1

Manila type neutral sized paper according to the invention was prepared by the method of Procedure A above. The composition of Example 1 and the properties obtained are shown below in Table I.

EXAMPLE 2

A manila paper was prepared by utilizing conventional alum and rosin internal size according to Procedure B. The composition and properties are shown below in Table I.

The paper is utilized as the face paper of gypsum wallboard, which faces outwardly when the board is mounted on the stud frames. For both Examples 1 and 2 the paper consists of five plies of filler stock made from Kraft clippings and waste news, and two plies faced outwardly made from flyleaf shavings stock. The data presented in Table I below compares the properties of the neutral sized manila paper with the paper sized with alum and rosin.

TABLE I

MANILA PAPER

| A. Comparative Compositions, % Dry Weight of Paper | | | |
|---|---|---|---|
| Composition Compared | Example #1 Neutral Size | Example #2 Alum + Rosin | Percent Difference* |
| Sizing Agent | 0.43 | 0.70 | −38.6 |
| Dry Alum | 0.038 | 1.65 | −97.7 |
| Dry Cationic Starch | 0.65 | | — |
| Dry Silicone Solids | 0.16 | 0.22 | −27.3 |
| $CaCO_3$ | 3.5 | — | — |
| Soft Stock (Flyleaf & Waste News) | 56.45 | 53.10 | +6.3 |
| Total Fiber Stock | 95.22 | 97.43 | −2.3 |
| **B. Comparative Paper Properties, Units Indicated** | | | |
| Property Compared | | | |
| Weight / Unit Area (lb/1000 ft$^2$) | 52.3 | 54.5 | −4.0 |
| Thickness, Mils | 14.5 | 16.5 | −12.1 |
| Tensile Machine Direction | 97 | 85 | +14.1 |
| Strength, Cross Direction lb/in. | 24.0 | 23.5 | +2.1 |
| Sheffield Porosity, | | | |

TABLE I-continued

| MANILA PAPER | | | |
|---|---|---|---|
| Seconds | 120 | 90 | +33.3 |
| Accel. Bondliner Cobb Test, Grams | 0.60 | 0.55 | +9.1 |
| Topliner Spread Test, 1/16 in. spread | 12 | 10 | +20.0 |
| C. Comparative Process Variables, Units Indicated | | | |
| Variable Compared | | | |
| Paper Machine Speed fpm | 402 | 374 | +7.5 |
| Electrical Energy Used $\frac{100 \text{ kw-hr}}{\text{Saleable Ton}}$ | 3.9 | 4.1 | −4.9 |
| Drying Steam Used $\frac{\text{MMBTU}}{\text{Saleable Ton}}$ | 7.7 | 8.9 | −13.5 |

*Denoted as: $\frac{\text{Neutral Size} - \text{Alum and Rosin}}{\text{Alum and Rosin}}$ (100)

As can be seen in Table I, the use of a neutral size in the paper permitted a large reduction to be made in the amount of sizing agent and alum used to size the paper. The neutral size also permits a significant reduction in the amount of silicone surface size and permits a 6% increase in the amount of cheaper soft stock used. The above improvements in composition were achieved with a 4% reduction in sheet weight/unit area, a 14% increase in machine direction sheet tensile strength, and an insignificantly small change in bondliner and topliner water resistance. The test indicating the extent of topliner water resistance is the liner spread test which has an inverse relationship to water resistance and constitutes the width that a drop widens out to in a unit time. The Cobb Test which measures the weight of moisture picked up per unit area is an inverse indicator of the bondliner water resistance. On manila paper the use of neutral size also provides a 7.5% increase in the speed of the paper machine or the rate at which the paper is produced, and 5% and 13.5% reductions in electrical energy and drying steam, respectively, utilized in the papermaking process.

The following two examples illustrate the preparation of newslined paper which is paper generally applied to the back side of the gypsum board as it is mounted on stud frames. The paper consists of seven plies of filler furnish made from old corrugated, sections and waste telephone directory clippings.

EXAMPLE 3

Newslined paper was prepared having neutral size according to the present invention by the process of Procedure A. The composition and properties measured are shown in Table II below.

EXAMPLE 4

Newslined paper was prepared with conventional rosin and alum size paper according to the prior art, and produced according to Procedure B. The composition and properties are shown below in Table II.

The results of the tests shown in Table II indicate that the use of neutral size permitted a 4% reduction in sheet weight/unit area, and 11% and 17% reductions in electrical energy and drying steam consumptions, respectively. Neutral size applied to newslined afforded a 5% increase in machine speed or production rate. These improvements were attained with no reduction in tensile strength nor any appreciable reduction in soft stock used.

TABLE 11

| NEWSLINED PAPER | | | |
|---|---|---|---|
| A. Comparative Compositions, % Dry Weight of Paper | | | |
| Composition Compared | Example #3 Neutral Size | Example #4 Alum + Rosin | Percent Difference* |
| Sizing Agent | 0.275 | 0.55 | −50.0 |
| Dry Alum | 0.038 | 1.65 | −97.7 |
| Dry Cationic Starch | 0.55 | — | — |
| Dry Silicone Solids | 0.016 | 0.02 | −20.0 |
| $CaCO_3$ | 3.5 | — | — |
| Soft Stock (Sections + Telephone Bk. Cuttings) | 57.38 | 58.67 | −2.2 |
| Total Fiber Stock | 95.62 | 97.78 | −2.2 |
| B. Comparative Paper Properties, Units Indicated | | | |
| Property Compared | | | |
| $\frac{\text{Weight}}{\text{Unit Area}}$ (lb/1000 ft$^2$) | 52.6 | 54.9 | −4.2 |
| Thickness, Mils | 15.0 | 16.5 | −9.1 |
| Tensile Machine Direction | 88 | 85 | +3.5 |
| Strength, Cross Direction lb/in. | 23.5 | 23.5 | 0.0 |
| Sheffield Porosity, Seconds | 53 | 45 | +17.7 |
| Accel. Bondliner Cobb Test, Grams | 0.61 | 0.55 | +10.9 |

TABLE 11-continued

| NEWSLINED PAPER | | | |
|---|---|---|---|
| C. Comparative Process Variables, Units Indicated | | | |
| Variable Compared | | | |
| Paper Machine Speed, fpm | 389 | 370 | +5.1 |
| Electrical Energy Used | | | |
| 100 kw-hr / Saleable Ton | 3.9 | 4.4 | −11.4 |
| Drying Steam Used | | | |
| MMBTU / Saleable Ton | 7.4 | 8.9 | −16.9 |

*Denoted as: $\frac{\text{Neutral Size} - \text{Alum and Rosin}}{\text{Alum and Rosin}}$ (100)

The following two examples illustrate the preparation of sheathing paper. Sheathing paper is a highly water-resistant paper produced in a manner similar to that of newslined, and is applied to both front and back faces of asphalt-wax emulsion-treated wallboard. The paper is subsequently surface-sized on the outer face with an emulsion of asphalt and wax, according to conventional procedures. The sheathing board, formed with a gypsum core is used as exterior wallboard and is covered with appropriate siding material.

EXAMPLE 5

A sheathing paper prepared with neutral size according to the invention according to Procedure A. The composition and properties measured are shown below in Table III.

EXAMPLE 6

A sheathing paper was prepared according to Procedure B utilizing rosin and alum size. The composition and properties measured are found below in Table III.

The contribution of the use of neutral size to sheathing paper constitutes the provision of sufficient internal sizing to meet water resistance specifications without the large amounts of alum required in sheathing paper sized with alum and rosin size.

TABLE III

| SHEATHING PAPER | | | |
|---|---|---|---|
| A. Comparative Compositions, % Dry Weight of Paper | | | |
| Composition Compared | Example #5 Neutral Size | Example #6 Alum + Rosin | Percent Difference* |
| Sizing Agent | 0.275 | 1.30 | −78.8 |
| Dry Alum | 0.038 | 2.45 | −98.4 |
| Dry Cationic Starch | 0.55 | — | — |
| Dry Silicone Solids | 0.016 | — | — |
| $CaCO_3$ | 3.5 | — | — |
| Soft Stock (Sections + Telephone Bk. Cuttings) | 57.37 | 57.75 | −0.7 |
| Total Fiber Stock | 95.62 | 96.25 | −0.7 |
| B. Comparative Paper Properties, Units Indicated | | | |
| Property Compared | | | |
| Weight / Unit Area (lb/1000 ft$^2$) | 53.0 | 58.2 | −8.9 |
| Thickness, Mils | 16 | 18 | −11.1 |
| Tensile Machine Direction | 94 | 83 | +13.3 |
| Strength, Cross Direction lb/in. | 24 | 22 | +9.1 |
| Sheffield Porosity, Seconds | 58 | 60 | −3.3 |
| Accel. Bondliner Cobb Test, Grams | 0.60 | 0.55 | +9.1 |
| C. Comparative Process Variables, Units Indicated | | | |
| Variable Compared | | | |
| Electrical Energy Used | | | |
| 100 kw-hr / Saleable Ton | 4.7 | 4.1 | +14.6 |
| Drying Steam Used: | | | |
| 100 kw-hr / Saleable Ton | 24.9 | 26.7 | −7.6 |
| MMBTU / Saleable Ton | 8.5 | 9.2 | |
| Total Energy Used | 29.6 | 30.8 | −3.3 |
| Paper Machine Speed, fpm | 386 | 350 | +10.3 |

*Denoted as: $\frac{\text{Neutral Size} - \text{Alum and Rosin}}{\text{Alum and Rosin}}$ (100)

In Examples 7 and 8 which follow, papers were prepared suitable for use as the face paper of gypsum board which is subsequently decorated with plaster. As such, it has special face water absorption requirements to make the wet plaster adhere to the paper surface. Typically, the paper consists of three unsized liner plies faced outwardly which are formed from dyed waste news stock, and four filler plies made from old corrugated and waste news paper stocks. The thickness of the liner plies is adjusted to provide the degree of water absorption required. Only the bottom three filler plies are sized internally.

EXAMPLE 7

A paper suitable for use in gypsum board which is adapted to be decorated with plaster was prepared with neutral size according to the invention as described in Procedure A. The formulation and properties measured are set out in Table IV.

EXAMPLE 8

A paper or preparing gypsum board adapted to be decorated with plaster was prepared with conventional formulations and sized with rosin and alum, as described in Procedure B. The formulation and properties determined are shown in Table IV below.

The results show that the neutral size application to paper for plaster decoration offers advantages over rosin and alum sized paper of the same type. The advantage as disclosed from the data below is that there is little or no migration of the size from the plies which are sized internally. The significance of this is that more of the unsized liner actually remains unsized, so that there is therefore less of the liner needed to obtain the desired degree of absorbency on neutral sized paper.

The liner absorbency is also benefited by the lack of acidity of the system which in itself provides some sizing of the liner furnish. The practical result of the properties of neutral sized paper is that a 9% reduction in weight/unit area is accomplished accompanying a 13% reduction in paper thickness and a substantial increase in paper machine speed. A 20% machine speed increase is obtained as a result of the better drainage and drying characteristics of the sheet as demonstrated by the 28% reduction in porosity value which relates inversely to the actual sheet porosity. This improvement in porosity is reflected in the 8% reduction in drying steam used to dry neutral sized paper.

As shown, good tensile strength, bondliner water resistance and topliner absorptions were obtained under the conditions shown in Table IV below with a small reduction in soft stock. The topliner absorption test which measures the ability of the topliner to absorb water is carried out by determining the amount of water picked up by the sheet when clamped under a 4 inch square ring which contains a head of 70° F. temperature water. Water pickups after 4 minutes and after an additional 16 minutes of standing are determined.

TABLE IV

PAPER FOR PLASTER APPLICATION

| Composition Compared | Example #7 Neutral Size | Example #8 Alum + Rosin | Percent Difference* |
|---|---|---|---|
| **A. Comparative Compositions, % Dry Weight of Paper** | | | |
| Sizing Agent | 0.225 | 1.20 | −81.3 |
| Dry Alum | 0.038 | 2.20 | −98.3 |
| Dry Cationic Starch | 0.55 | — | — |
| Dry Silicone Solids | 0.016 | 0.022 | −27.3 |
| $CaCO_3$ | 3.5 | — | — |
| Soft Stock (Waste News) | 63.43 | 66.35 | −4.4 |
| Total Fiber Stock | 95.67 | 96.58 | −0.9 |
| **B. Comparative Paper Properties, Units Indicated** | | | |
| Property Compared | | | |
| Weight / Unit Area (lb/1000 ft$^2$) | 60.3 | 66.0 | −8.6 |
| Thickness, Topliner | 8 | 10 | −20.0 |
| Mils, Filler | 12 | 13 | −7.7 |
| Total | 20 | 23 | −13.0 |
| Tensile Machine Direction | 95 | 90 | +5.6 |
| Strength, Cross Direction lb/in. | 25.5 | 25.5 | 0.0 |
| Sheffield Porosity, Seconds | 47 | 65 | −27.7 |
| Accel. Bondliner Cobb Test, Grams | 0.64 | 0.55 | +16.4 |
| Topliner Absorptions, 1st. 4 min. | 3.2 | 3.2 | 0.0 |
| Grams, 16 Added Minutes | 0.6 | 0.6 | 0.0 |
| **C. Comparative Process Variables, Units Indicated** | | | |
| Variable Compared | | | |
| Paper Machine Speed, fpm | 337 | 280 | +20.4 |
| Electrical Energy Used 100 kw-hr / Saleable Ton | 4.4 | 4.6 | −4.3 |
| Drying Steam Used | | | |

TABLE IV-continued

| PAPER FOR PLASTER APPLICATION | | | |
|---|---|---|---|
| $\frac{\text{MMBTU}}{\text{Saleable Ton}}$ | 8.4 | 9.1 | −7.7 |

*Denoted as: $\frac{\text{Neutral Size} - \text{Alum and Rosin}}{\text{Alum and Rosin}}$ (100)

In Examples 9 and 10 which follow, paper for wallboard having high humidity applications was prepared. This paper is utilized for making gypsum wallboard in which the gypsum is provided with an asphalt-wax treatment for use in high humidity environments such as bathrooms. The paper is fabricated in a manner similar to that in which manila is fabricated, except that the topliner is acidified with 33 lb/ply ton of alum. The acidification does not adversely influence the filler which comprises 70%–75% of the total sheet.

EXAMPLE 9

A paper for wallboard having high humidity applications was prepared with neutral size according to the invention using Procedure A, and having formulations and properties shown below in Table V.

EXAMPLE 10

A paper for wallboard having high humidity applications was prepared according to Procedure B using conventional alum and rosin size. The formulation and properties are shown below in Table V.

The data shown in Table V indicate that on humidity resistant paper the use of neutral size in Example #9 provided a 4% reduction in basis weight and 6 and 9% increases in machine and cross direction tensile strengths respectively. The paper having neutral size also gave a 4% increase in paper machine speed and a 10% reduction in electrical energy used.

The use of topliner sizing over neutral sized paper appears to have been definitely beneficial, as indicated by the reduction in the topliner Cobb Test water pickup.

TABLE V

| PAPER FOR WALLBOARD HAVING HIGH HUMIDITY APPLICATIONS | | | |
|---|---|---|---|
| A. Comparative Compositions, % Dry Weight of Paper | | | |
| Composition Compared | Example #9 Neutral Size | Example #10 Alum + Rosin | Percent Difference |
| Sizing Agent | 0.31 | 0.95 | −67.4 |
| Dry Alum | 0.495 | 1.65 | −70.0 |
| Dry Cationic Starch | 0.65 | — | — |
| Dry Silicone Solids | 0.016 | 0.022 | −27.3 |
| $CaCO_3$ | 3.5 | — | — |
| Soft Stock (Waste news + Flyleaf) | 51.24 | 53.07 | −3.4 |
| Total Fiber Stock | 95.03 | 97.38 | −2.4 |
| B. Comparative Paper Properties, Units Indicated | | | |
| Property Compared | | | |
| $\frac{\text{Weight}}{\text{Unit Area}}$ (lb/1000 ft$^2$) | 52.6 | 54.8 | −4.0 |
| Thickness, Mils | 15.5 | 16.5 | −6.1 |
| Tensile Machine Direction | 90 | 85 | +5.9 |
| Strength, Cross Direction lb/in. | 25.5 | 23.5 | +8.5 |
| Sheffield Porosity, Seconds | 129 | 110 | +17.3 |
| Accel. Bondliner Cobb Test, Grams | 0.57 | 0.55 | +3.6 |
| Accel. Topliner Cobb test, Grams | 0.40 | 0.60 | −33.3 |
| C. Comparative Process Variables, Units Indicated | | | |
| Variable Compared | | | |
| Paper Machine Speed, fpm | 385 | 371 | +3.9 |
| Electrical Energy Used $\frac{\text{100 kw-hr}}{\text{Saleable Ton}}$ | 3.7 | 4.1 | −9.8 |
| Drying Steam Used $\frac{\text{MMBTU}}{\text{Saleable Ton}}$ | 8.8 | 8.9 | −1.1 |

*Denoted as: $\frac{\text{Neutral Size} - \text{Alum and Rosin}}{\text{Alum and Rosin}}$ (100)

PROCEDURE C

PRODUCTION OF GYPSUM WALLBOARD

Gypsum wallboard was produced by discharging a stucco slurry from a mixer onto prepared paper with the topliner face downward while the paper was moving continuously. A top sheet, which is newslined, was brought into contact with the upper surface of the slurry, and subsequently the combination of facing papers and slurry was passed under a forming roll to distribute the slurry uniformly and to form the board into a uniform cross-section. The edges of the paper were folded up and over the edges of the top paper, and the edges of the board were formed in the same operation.

The wet gypsum board was carried through the forming section of the board machine on a continuously moving belt until the board core was fully hydrated to calcium sulfate dihydrate. Subsequently, the board was conveyed onto continuously moving strip belt conveyors to the knife section where the board was cut into conventionally desired lengths.

The board was then inverted with the manila face up and fed into a drying kiln on continuously turning rollers, where it was dried to a uniform 5–6% moisture content. The board was inspected and then stacked into packages.

Testing of Gypsum Wallboard

Before gypsum wallboard is marketed it is first subjected to specific quality control tests to ascertain that the board meets quality standards. Among the various tests which are generally conducted are ASTM nail pull and transverse strengths. Also tested are humidified bond for both face and backsides of the board, face Cobbs and total immersion absorption water resistance tests on board to be used for high humidity application and/or sheathing board, and face absorption water absorptiveness tests on board for plaster application.

The nail pull test consists of applying an ever-increasing amount of weight on a specially designed nail until the head is pulled through the board sample. Weight at failure is recorded.

Transverse strength tests are carried out by applying a force downwardly in the center of the specimen which is supported at two opposing outer edges. The face which is positioned downwardly is the face which is tested. Force applied at failure is the measurement of transverse strength.

The humidified bond test consists of humidifying the board for three hours at 90% relative humidity and 90° F. temperature, and then applying a force on the board sufficient to break the bond between the paper and the board core. The applied force or weight at failure is the measure of bond strength.

Face Cobb and absorption tests are carried out as discussed above.

The total immersion water absorption tests are conducted by immersing a 12 inch by 12 inch sample of board for two hours in 70° F. temperature water. The weight of water absorbed is determined by difference and converted to percent absorption based on dry weight.

The following examples illustrate the production of gypsum wallboard utilizing neutral-sized paper according to the invention as well as similar board prepared with conventional rosin and alum-sized paper.

EXAMPLE 11

Utilizing paper produced in Example 1 with neutral size, gypsum wallboard was formed according to Procedure C above. The performance data are shown below in Table VI.

EXAMPLE 12

Utilizing the paper prepared in Example 2 by the method of Procedure B above, gypsum wallboard was prepared from rosin and alum-sized paper according to Procedure C above. The data obtained from tests are shown in Table VI below.

The data shown in Table VI compares the performance of neutral sized paper prepared gypsum board with alum and rosin sized paper prepared gypsum board when utilized to prepare regular gypsum wallboard of one-half inch thickness and 1700–1750 lb/1000 square feet board weight.

Humidified bond test results indicate that the bonding tendency of the neutral sized paper is significantly better than that of alum and rosin sized paper based on bond strength.

Transverse strength test data illustrate that the neutral sized newslined surpasses the alum and rosin sized paper in strength, where the neutral sized manila is comparable in strength to the alum and rosin sized paper.

Qualitative tests relating to the suitability of the wallboard for joint taping indicate that the board produced with neutral-sized paper tapes as well as board produced with alum and rosin-sized paper.

Qualitative paintability tests have shown that the painting characteristics of the neutral-sized manila face paper were equal to those of alum and rosin-sized face paper with paints commonly used in the trade.

TABLE VI

| REGULAR GYPSUM WALLBOARD | | |
|---|---|---|
| Property Compared | Example #11 Neutral Size | Example #12 Alum +Rosin |
| Humidified Bond | | |
| Manila | | |
| Bond Strength, $lb_f$ | 11.0 | 7.4 |
| Newslined | | |
| Bond Strength, $lb_f$ | 12.6 | 7.9 |
| Transverse Strengths | | |
| Manila | | |
| Across, $lb_f$ | 150.0 | 155.0 |
| Parallel, $lb_f$ | 62.5 | 50.0 |
| Newslined | | |
| Across, $lb_f$ | 167.0 | 160.0 |
| Parallel, $lb_f$ | 67.5 | 56.3 |
| Nail Pull, $lb_f$ | 93.8 | 90.3 |

In Examples 13 and 14 gypsum wallboard was prepared suitable for subsequent plaster application. In Example 13 the paper utilized was that formed in Example 7, and in Example 14 the paper utilized was that formed in Example 8. Table VII below provides the results of tests made on the finished wallboard samples.

Referring to the data in Table VII, it can be seen that the water absorption tests results for the neutral-sized face paper are well within the desired ranges, indicating the suitability of neutral-sized paper for the production of wallboard for plaster application. The test data additionally indicate that under conditions of aging in exposure to sunlight during construction, the board of Example 13 produced with the neutral size should show superior bond of plaster to face paper of the board compared to the properties of the board produced in Example 14 utilizing alum and rosin as a paper size.

In the plaster board test, samples of board were exposed either face or back or not at all to ultraviolet light to simulate exposure to the sun. In preparing the finished product, plaster is applied to the board face and allowed to set. Subsequently, the quality of the bond of the dried plaster to the board is tested.

TABLE VII

| BOARDS FOR PLASTER APPLICATION | | | |
|---|---|---|---|
| Property Compared | Example #13 Neutral Size | Example #14 Alum + Rosin | Desired Range |
| Face Absorption Test, Grams | | | |
| After 4 minutes | 2.11 | 2.58 | 1.6–3.0 |
| Additional 16 minutes | 0.65 | 0.62 | 0.4–1.0 |
| Plaster Bond to UV Light-Aged Board, 12 Hours of Aging | | | |
| Top Exposed | Fair | Poor | |
| Bottom Exposed | Good | Fair | |
| Unexposed | Good | Good | |

In Examples 15 A and 16 A gypsum wallboard was made utilizing the paper of Examples 9 and 10 according to Procedure C. In Examples 15 B and 16 B, according to Procedure C, gypsum wallboard was made utilizing the papers used in Examples 5 and 6. The results are shown below in Table VIII.

Examples 15 A and B and 16 A and B—Gypsum Wallboard for High Humidity and Sheathing Applications In Table VIII water immersion test on samples #15 A and B of high humidity and sheathing boards respectively produced with neutral-sized papers according to the invention are presented. Test results on samples 16 A and B of corresponding gypsum boards made with alum and rosin-sized papers are also presented.

It is evident that the boards produced with neutral-sized papers have absorptions that are comparable to the boards produced with alum and rosin size and are within the desired ranges of absorption. These results indicate the suitability of neutral-sized papers in application to these specific gypsum boards.

TABLE VIII

| HIGH HUMIDITY APPLICATION AND SHEATHING BOARDS Water Immersion Absorption Test, % Absorption | | | |
|---|---|---|---|
| Board Compared | Example #15 Neutral Size | Example #16 Alum + Rosin | Desired Range |
| A. High Humidity Application Board | 3.6 | 3.6 | 0–5.0 |
| B. Sheathing Board | 6.5 | 6.3 | 0–10.0 |

Critical Composition and Process Variable Ranges

In Table IX below are shown the composition ranges of the various materials utilized in making of neutral-sized paper suitable for use in making gypsum wallboard.

TABLE IX

| NEUTRAL-SIZED PAPER CRITICAL COMPOSITION AND PROCESS VARIABLE RANGES | | |
|---|---|---|
| | Dry lb Dry Ton of Paper | Dry Weight % of Dry Paper |
| Composition Ranges | | |
| $CaCO_3$ Content | 40–100 | 2–10 |
| Cationic Starch | 10–14 | 0.5–0.7 |
| Sizing Agent (Succinic Acid Anhydride) | 3–7 | 0.15–0.35 |
| Silicone Surface Size | 0.3–0.5 | 0.015–0.025 |
| Dry Alum | 0.75–9.90 | 0.038–0.475 |
| Dry Fiber | — | 97.297–93.450 |
| Process Variable Ranges | | |
| Furnish Refining and Sheet Forming Stock pH | 7.0–7.8 | |

TABLE IX-continued

| NEUTRAL-SIZED PAPER CRITICAL COMPOSITION AND PROCESS VARIABLE RANGES | | |
|---|---|---|
| | Dry lb Dry Ton of Paper | Dry Weight % of Dry Paper |
| Dryer Pressure in Last Section of Dryers | 35 + psig (Minimum of Range is Indicated) | |
| Sheet Temperature Leaving Last Dryer Cylinder | 270 + °F. (Minimum of Range is Indicated) | |
| Sheet Moisture Leaving Last Dryer Cylinder | 1.50–2.50% | |

The neutral-sized paper of the present invention has several advantages when utilized as paper cover sheets for making gypsum wallboard over other papers conventionally used. First, because a neutral size is used, the fibers are stronger and as a result, the paper formed from equivalent amount of fibers as in the prior art produces stronger paper. Alternatively, less or cheaper fibers can be used, while still achieving the same strength as conventional papers utilizing a higher percentage of fibers. The use of a cationic starch as an emulsifying medium and retention aid insures the adherence of the size to the paper fibers. The use of a calcium carbonate buffer maintains the paper producing composition slurry in a neutral or slightly alkaline acid condition and prevents any acidic attack on the fibers. The use of an external size of an epoxy resin emulsion further aids in sizing the material and achieves a better bond between the paper and the gypsum core. Finally, the admixture of an acidic material such as alum to the epoxy resin to aid in curing the epoxy resin surface size greatly increases the effectiveness of the epoxy external size. Further, because the paper is lighter and more porous, savings are achieved in fuel used in drying the paper and gypsum board.

It is to be understood that the invention is not to be limited to the exact details of operation or materials described, as obvious modifications and equivalence will be apparent to one skilled in the art.

What is claimed is:

1. Gypsum wallboard comprising a core of set calcium sulfate dihydrate and a paper cover sheet bonded to each surface thereof, each of said paper cover sheets having been fabricated by first incorporating the ingredients including calcium carbonate into an aqueous slurry and then forming and drying said paper cover sheet, said ingredients comprising:

(A) a major proportion of cellulose fibers consisting essentially of waste paper stock providing an acidic furnish, (B) a cyclic dicarboxylic acid anhydride applied as an internal sizing agent having the structural formula:

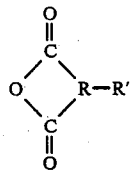

wherein R is selected from the group consisting of dimethylene and trimethylene radicals, and wherein R′ is a hydrophobic group containing more than 5 carbon atoms selected from the group consisting of alkyl, alkenyl, aralkyl and aralkenyl groups, (C) a cationic agent, and (D) a buffering agent comprising calcium carbonate adapted to maintain the aqueous paper slurry during forming at a pH of at least 7.

2. Gypsum wallboard according to claim 1, wherein a surface size coating is applied to at least the surface of the bond liner of said paper, comprising a silicone resin.

3. A paper according to claim 2, wherein said surface size also includes an acidic agent in an amount suitable for promoting the polymerization of said silicone resin.

4. Gypsum wallboard according to claim 3, wherein said cyclic dicarboxylic acid anhydride is a substituted succinic acid anhydride having a total of 15 to 20 carbon atoms.

5. Gypsum wallboard according to claim 3, wherein said substituted succinic acid anhydride is present in an amount of from about 0.15 to about 0.35 percent by dry weight.

6. Gypsum wallboard according to claim 3, wherein an emulsifying agent was added to said cyclic dicarboxylic acid anhydride.

7. Gypsum wallboard according to claim 3, wherein said cationic agent is a cationic starch.

8. Gypsum wallboard according to claim 7, wherein said cationic starch is present in an amount of about 0.5% to about 0.7% dry weight.

9. Gypsum wallboard according to claim 3, where said calcium carbonate is present in at least 2% by dry weight.

10. Gypsum wallboard according to claim 3 wherein said calcium carbonate is present in an amount of about 2% to about 10% by dry weight.

11. Gypsum wallboard according to claim 3, wherein said surface size is a silicone resin and said acidic agent is alum.

12. Gypsum wallboard according to claim 11, wherein said silicone resin is present in an amount of about 0.015% to about 0.025% dry weight, and the alum in said resin is present in an amount of about 2½ times the dry weight of the silicone resin.

13. Gypsum wallboard according to claim 11, wherein said silicone resin is a methyl polysiloxane resin.

14. Gypsum wallboard according to claim 11, wherein said silicone resin is an epoxy silicone resin.

15. A method for the production of gypsum wallboard utilizing a paper particularly suitable for use as cover sheets, said process comprising:

(A) preparing with mixing an aqueous slurry comprising in weight percent:

1. Cellulose fibers consisting essentially of waste paper stock providing an acidic furnish having a fiber freeness of from about 350 to 550 ml Canadian Standard Freeness,
2. a cyclic dicarboxylic acid anhydride applied as an internal sizing agent having the structural formula:

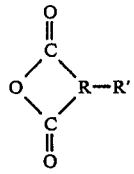

wherein R is selected from the group consisting of dimethylene and trimethylene radicals, and wherein R′ is a hydrophobic group containing more than 5 carbon atoms selected from the group consisting of alkyl, alkenyl, aralkyl and aralkenyl groups, 3. a cationic agent, and
4. a buffering agent comprising calcium carbonate adapted to maintain the paper during forming at a pH of at least 7, and (B) forming and drying said paper, (C) depositing an aqueous slurry of calcium sulfate hemihydrate between two sheets of said paper, and (D) setting and drying the gypsum wallboard formed thereby.

16. A method according to claim 15, wherein a surface size coating is applied to at least the surface of the bond liner of said paper, comprising a silicone resin.

17. A method according to claim 16, wherein said surface size also includes an acidic agent in an amount suitable for promoting the polymerization of said silicone resin.

18. A method according to claim 17, wherein said cyclic dicarboxylic acid anhydride is a substituted succinic acid anhydride having a total of 15 to 20 carbon atoms.

19. A method according to claim 17, wherein said substituted succinic acid anhydride is present in an amount of from about 0.15 to about 0.35 percent by dry weight.

20. A method according to claim 17, wherein an emulsifying agent is added to said cyclic dicarboxylic acid anhydride.

21. A method according to claim 17, wherein said cationic agent is a cationic starch.

22. A method according to claim 21, wherein said cationic starch is present in an amount of about 0.5% to about 0.7% dry weight.

23. A method according to claim 16, wherein said calcium carbonate is present in at least 2% by dry weight.

24. A method according to claim 16, wherein said calcium carbonate is present in an amount of about 2% to about 10% by dry weight.

25. A method according to claim 17, wherein said surface size is a silicone resin and said acidic agent is alum.

26. A method according to claim 25, wherein said silicone resin is present in an amount of about 0.015% to about 0.025% dry weight, and the alum in said resin is present in an amount of about 2½ times the dry weight of the silicone resin.

27. A method according to claim 25, wherein said silicone resin is a methyl polysiloxane resin.

28. A method according to claim 25, wherein said silicone resin is an epoxy silicone resin.

* * * * *